US006699009B2

(12) United States Patent
Fahrenbach

(10) Patent No.: US 6,699,009 B2
(45) Date of Patent: Mar. 2, 2004

(54) VACUUM PUMP

(75) Inventor: Peter Fahrenbach, Braunfels (DE)

(73) Assignee: Pfeiffer Vacuum GmbH, Asslar (DE)

( * ) Notice: Subject to any disclaimer, the term of this patent is extended or adjusted under 35 U.S.C. 154(b) by 24 days.

(21) Appl. No.: 10/075,409

(22) Filed: Feb. 13, 2002

(65) Prior Publication Data

US 2002/0114695 A1 Aug. 22, 2002

(30) Foreign Application Priority Data

Feb. 16, 2001 (DE) ..... 101 07 341

(51) Int. Cl.[7] ..... F04D 19/04
(52) U.S. Cl. ..... 415/90
(58) Field of Search ..... 415/90, 175, 176, 415/178, 143, 55.6, 55.5, 55.1; 417/372, 423.4, 423.8

(56) References Cited

U.S. PATENT DOCUMENTS 5,879,139 A * 3/1999 Hayashi et al. ..... 417/292
5,924,841 A * 7/1999 Okamura et al. ..... 415/90

FOREIGN PATENT DOCUMENTS

DE 19702456 A1 * 7/1998 ..... F04D/19/04

* cited by examiner

*Primary Examiner*—Edward K. Look
*Assistant Examiner*—Dwayne J. White
(74) *Attorney, Agent, or Firm*—Sidley Austin Brown & Wood, LLP

(57) ABSTRACT

A vacuum pump including a housing having a suction opening in its high-vacuum region, a gas outlet opening in its high pressure region, pump-active cooperating rotor and stator components arranged in the housing for pumping gases from the suction opening to the outlet opening, with an end of the pump-active components adjoining the high pressure region being connected with the gas outlet opening via intermediate chamber, a heating device provided in the intermediate chamber and connected with stator components, which are located in the high pressure region, by a connection having a high thermal conductibility, and thermal resistance elements for separating the heating device from the housing.

4 Claims, 1 Drawing Sheet

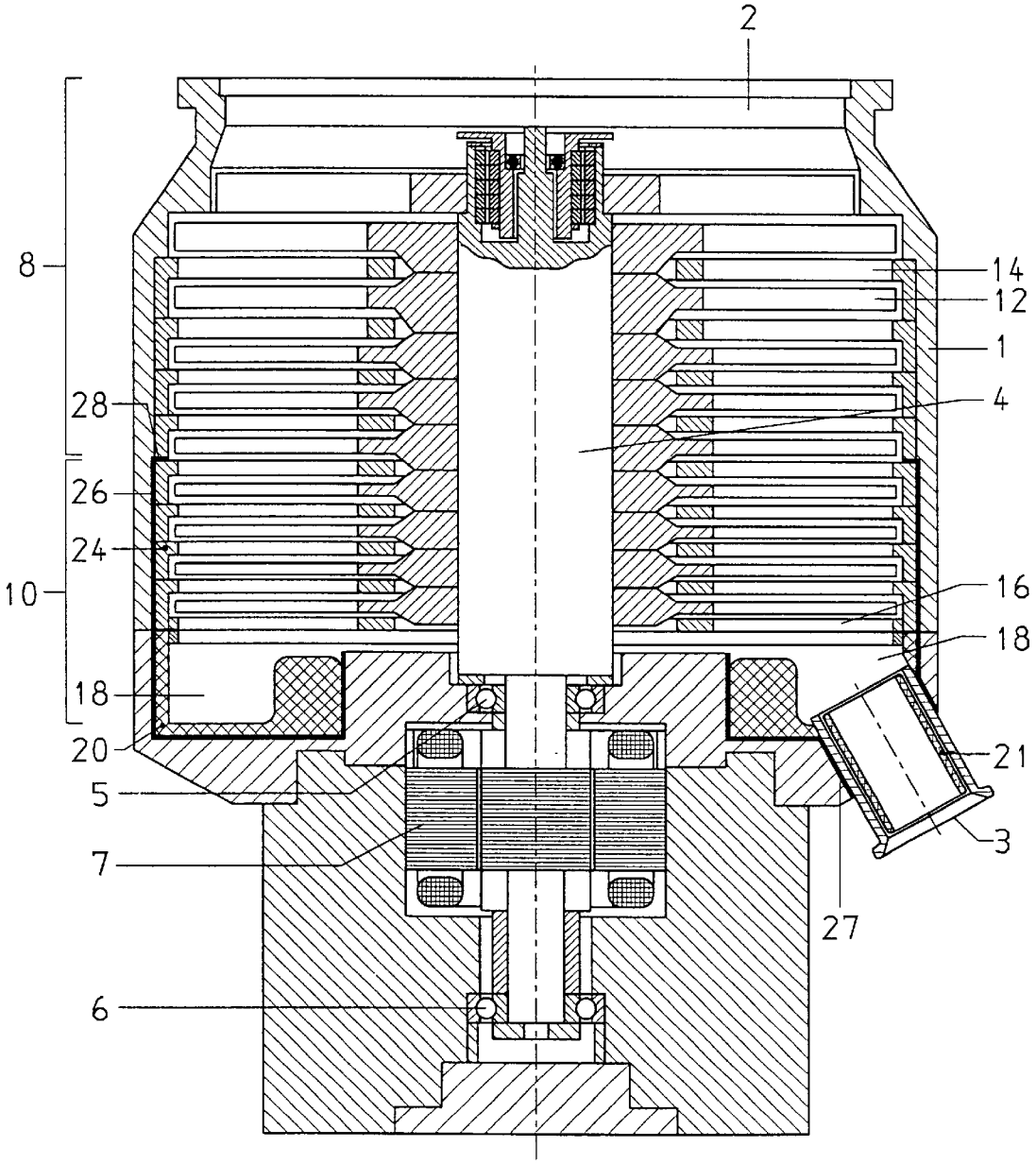
2
8
14
12
1
28
4
26
24
10
16
18
18
20
21
5
3
7
27
6

VACUUM PUMP

BACKGROUND OF INVENTION

1. Filed of the Invention

The present invention relates to a vacuum pump including a housing having a suction opening in its high-vacuum region, a gas outlet opening in its high pressure region, and an intermediate chamber adjoining the gas outlet opening, pump-active cooperating rotor and stator components arranged in the housing for pumping gases from the suction opening to the outlet opening, with an end of the pump-active components adjoining the high pressure region being connected with the gas outlet opening via the intermediate chamber.

2. Description of the Prior Art

Vacuum pumps of the type described above can be formed, e.g., as turbomolecular pumps, or as molecular pumps, such as Holweck pumps, or as a combination of both types of pumps. The present invention also extends to combination of pumps that discharge against atmospheric pressure after realizing high pressure such as, e.g. regenerative pumps.

Such vacuum pumps are formed, as a rule, of a number of stages having different configurations, with each stage including rotor and stator components. The delivered gas flows through these pump-active components. The field of application of these pumps extends to processes in which a large quantity of easily condensable gases is formed, e.g., such as chemical processes or processes associated with manufacturing of semiconductors. With these pumps, gases flow from a high-vacuum region to a pressure region, in which a laminar flow prevails or in which the gas is compressed to atmospheric pressure. This means that in this region of high pressures, a relatively large quantity of gas is being pumped. In case when these gases are easily condensable, which is particularly the case at low temperatures, a significant amount of deposition of liquid or a solid materials takes place. This deposition leads to corrosion and etching that can result in destruction of separate components of a pump or an entire pump. This is particularly critical for types of pumps, which were discussed above, because their optimal operation can only be obtained at their high rotational speeds with a very small distance between the stationary and rotatable parts.

It was suggested to prevent formation of undesirable deposits by heating the critical regions (DE-A-197 02 456, EP-A 0646 290). In the constructions described in these references, the critical regions are heated by feeding heat via large-surfaces. The drawback of this solution consists in that the pump components, which are not subjected to precipitation, become heated, e.g., such as the housing high-vacuum connections, bearings, the drive. This leads, in addition to a very high energy consumption, to further drawbacks such as undesirable expansion of components having very narrow tolerances, damage of the drive bearing parts, and to a danger of injury to personnel as a result of a contact with a heated part.

Accordingly, the object of the preset invention is to provide a vacuum pump in which only the components susceptible to precipitation are heated.

SUMMARY OF THE INVENTION

This and other objects of the present invention, which will become apparent hereinafter, are achieved by providing, in the intermediate chamber, heating means connected with stator components located in the pressure region by a connection having a high thermal conductibility, and by providing thermal resistance means for separating the heating means from the housing.

The present invention ensures that only the critical components, i.e., only those components, which are particularly susceptible to precipitation of condensable material, are heated. By providing thermal connections having a high thermal conductibility, the heat is specifically directed to critical points. Other components, e.g. the housing, high-vacuum connections, bearings, and the drive, are protected from heating by thermal insulation. The advantages of these measures consists in reduced energy consumption, prevention of an undesirable expansion of components with narrow tolerances, prevention of injury to the personnel as a result of contact with heated parts. By increasing the flow rate, the pump output can be increased. The small heat capacity of the heated parts and of the stator components in the region of high pressure results in a reduced time of heating and, thereby, in reduced power consumption.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

In the Drawings:

Single FIGURE shows a cross-sectional view of a vacuum pump according to the present invention.

DETAILED DESCRIPTION OF THE PREFERRED EMBODIMENT

The present invention will be explained in detail with reference to a turbomolecular pump that represents one type of a vacuum pump according to the present invention.

The turbomolecular pump, which is shown in the drawing figure, includes a housing 1 provided with a suction opening 2 in its high-vacuum region 8 and an outlet gas opening 3 in its forevacuum region 10. The turbomolecular pump further includes a rotor shaft 4 which is supported in bearings 5 and 6 and is driven by a motor 7. On the rotor shaft 4, there are arranged rotor components 12 which have a pump-active structure and cooperate with stator components 14, which likewise can have a pump-active structure, for producing a pumping effect.

The gases, which are delivered through the suction opening 2, are fed by pump-active components to the gas outlet opening 3 through a forevacuum-side, intermediate chamber 18. Accordingly to the present invention, the intermediate chamber 18 is provided with heating means 20 and is connected with fore vacuum-side stator components 24 via thermal connection with a high thermal conductibility. The thermal connection is produced by forming the stator components 24 of a material having a high thermal conductibility and by providing a large-surface contact therebetween. The intermediate chamber 18 of the housing 1 and the high vacuum-side, stator components 14 are separated from each other by thermal resistances 28. Additionally, the gas outlet opening can likewise be provided with heating means 21 and be thermally separated from adjoining housing parts by thermal resistances 27.

Because the present invention, being described with reference to the turbomolecular pump, extends to pumps and pump systems, which discharge against up to the atmospheric pressure, the term "fore-vacuum" includes high-pressure regions up to the atmospheric pressure.

Though the present invention was shown and described with references to the preferred embodiment, such is merely illustrative of the present invention and is not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A vacuum pump, comprising a housing having a suction opening in a high-vacuum region thereof, a gas outlet opening in a high pressure region thereof, and an intermediate chamber adjoining the gas outlet opening; pump-active cooperating rotor and stator components arranged in the housing for pumping gases from the suction opening to the outlet opening, with an end of the pump-active components adjoining the high pressure region being connected with the gas outlet opening via the intermediate chamber; heating means provided in the intermediate chamber and connected with stator components, which are located in the high pressure region, by a connection having a high thermal conductibility; thermal resistance means for separating the heating means from the housing; and thermal resistance means for thermally separating the stator components, which are located in the high pressure region, from stator components located in the high-vacuum region.

2. A vacuum pump as set forth in claim 1, further comprising heating means located in the gas outlet opening.

3. A vacuum pump as set forth in claim 1, wherein the high thermal conductibility connection includes forming the stator components, which are located in the high pressure region, of a material having high thermal conductibility and by providing a large-surface contact therebetween.

4. A vacuum pump as set forth in claim 1, comprising additional thermal resistance means for thermally separating the gas outlet opening from adjoining its housing parts.

* * * * *